United States Patent [19]

Carter

[11] 4,062,450

[45] Dec. 13, 1977

[54] DISPLAY DEVICE

[75] Inventor: Jared E. Carter, Dayton, Ohio

[73] Assignee: Dayco Corporation, Dayton, Ohio

[21] Appl. No.: 689,315

[22] Filed: May 24, 1976

[51] Int. Cl.[2] ..... B65D 75/00; B65D 85/08

[52] U.S. Cl. ..... 206/485; 206/806

[58] Field of Search ..... 206/45.14, 443, 485–486, 206/491, 525, 806, 446, 329, 69, 294; 211/60 R, 72–73, 65–66; 229/16 D, 41 R, DIG. 7; 294/87.2

[56] References Cited

U.S. PATENT DOCUMENTS

| | | | |
|---|---|---|---|
| 1,896,677 | 2/1933 | Myers | 211/73 |
| 1,896,678 | 2/1933 | Myers | 206/486 X |
| 2,252,235 | 8/1941 | Snelling | 211/73 X |
| 2,823,063 | 2/1958 | Toensmeier | 294/87.2 |
| 2,896,853 | 7/1959 | Curran | 206/806 X |
| 3,184,046 | 5/1965 | Berg | 206/45.14 |
| 3,847,282 | 11/1974 | Collura et al. | 206/45.14 X |
| 3,918,583 | 11/1975 | Adams | 206/485 X |

FOREIGN PATENT DOCUMENTS

| | | | |
|---|---|---|---|
| 1,529,094 | 5/1968 | France | 206/194 |

*Primary Examiner*—Steven E. Lipman
*Attorney, Agent, or Firm*—Reuben Wolk

[57] ABSTRACT

A display device for holding and displaying elongated tubular objects such as fluid conveying hose. The device is composed of a material such as paperboard and includes a vertical section which may be hung in display fashion, and spaced horizontal portions having circular openings through which the hose is inserted. The weight of the hose pulls the horizontal portions downward at a slight angle to lock the hose in place within the openings.

5 Claims, 6 Drawing Figures

DISPLAY DEVICE

BACKGROUND OF THE INVENTION

Display devices have long been utilized as a means for holding various products in such a manner that they are neatly displayed while secured so that they may be easily removed. In conjunction with elongated tubular objects such as hose, prior art devices consist of box-like members having four vertical sides with openings at the top and bottom through which the hose may be inserted, the device then being capable of hanging on the wall for display and dispensing. This design has been reasonably successful where the hose has corrugations so that these corrugations may be hooked on the top of the vertical sides to hold them in place. However, such a design is worthless for hose having a smooth outside diameter, since there is no way of securing these to the package unless additional devices, such as hangers or clips, are used to assist in supporting the hose. Such devices are expensive and cumbersome. Even corrugated hose can slip loose and fall through the display package if it is accidentally jostled, and therefore the value of such a package is considerably minimized.

The importance of such devices has grown in recent years, because of new merchandising systems in which it has become important to display products in a simple, yet efficient manner, while at the same time it is necessary to remove such devices very quickly when being sold. This situation exists whether a self-service type of operation is being utilized or a behind-the-counter type of operation is required.

SUMMARY OF THE INVENTION

The present invention overcomes the deficiencies of prior art display devices and has as its primary objective a display package which is inexpensive to manufacture, presents an attractive appearance, and above all makes it possible for the first time to hang tubular objects such as hose in a manner that is secure without the use of clips, yet presents the attractive appearance required for good marketing practices. Instead of utilizing vertical sides and completely open tops and bottoms, the present device instead consists of a vertical member which may be hung for display and spaced horizontal portions which extend outwardly from the hanging portion, and are interconnected by another vertical portion. Instead of the open top and bottom, the device has open sides and the tubular object, or hose, is secured by creating two circular openings within the horizontal portions of the device. By making these circular openings slightly larger than the outside diameters of the hose to be displayed, it is a very simple matter to slide the hose through these openings, and as a result, the weight of the hose itself will pull downward on the horizontal portions at a slight angle. The surface of the hose, contacting the edges of the openings tend to lock the hose in place so that it cannot fall out and only be removed by moving the horizontal portions upwardly so that they have a right angular relationship with the vertical member instead of an angular position, thereby freeing the edges of opening from tight contact with the hose and allowing the hose to be removed.

As will be described, the device is formed of a single sheet of paperboard or similar material which is prestamped and scored to make it easy to stack and ship, and very inexpensive to manufacture.

BRIEF DESCRIPTION OF THE DRAWINGS

The detailed features of the invention are readily apparent from typical embodiments presented in the drawings, which are discussed below.

DESCRIPTION OF THE PREFERRED EMBODIMENT

Figure 1:
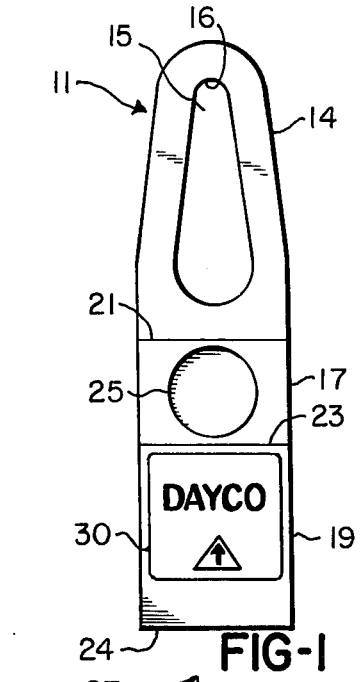
FIG. 1 is a front view of the device, folded flat, prior to its actual use.
Figure 2:
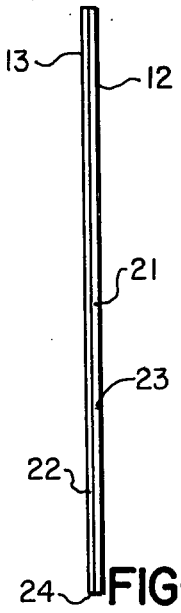
FIG. 2 is a side view of the flat folded device illustrating its stackable feature.
Figure 3:
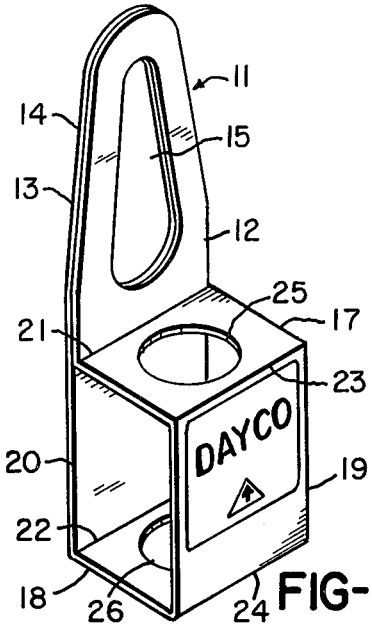
FIG. 3 is a perspective view of the display device which illustrates the relationship of the various portions of the device, in which the horizontally extending portions are at right angles to the vertical member, prior to insertion of a hose.

Referring now to FIGS. 1 and 2, the novel display device 11 is made of a single piece of paperboard or similar material which has been scored and cut then folded, as illustrated in these figures, so that it consists of a front portion 12 and a rear portion 13, folded along score line 24. The upper segment of the device is designated by reference numeral 14 and consists of the upper parts of portions 12 and 13 which have been glued or otherwise adhered together to form a unitary segment. A generally elliptical opening 15 has been punched or otherwise formed through both portions to form a hanging member, which is designated at its upper end by reference numeral 16. Referring further to FIG. 3, it can be seen that the rear portion 13 includes a lower member 20 which is in vertical alignment with segment 14, while the forward portion 12 has been formed so that its lower part may be folded out, as shown in FIG. 3, to form spaced horizontal portions 17 and 18 interconnected by a vertical portion 19. This is accomplished by folding portion 17 along score line 21 and by folding portion 18 along score line 22, the portion 19 being thus formed by score lines 23 and 24. The score lines are also illustrated in FIG. 2. The score lines 21 and 22 extend only partially through the forward portion 12, and act somewhat as a hinge so that the horizontal portions 17 and 18 are free to move up and down. Circular openings 25 and 26 are formed in portions 17 and 18 and are in substantial alignment with each other.

In order to identify the source of the product, a label 30 is applied to the portion 19. The label illustrated bears only the manufacturer's name, but it is obvious that other designations, such as part number and diameter, may also appear thereon. It is contemplated that a wide variety of diameters may be displayed with this novel device, probably ranging from about ¼ inch to 3 inches.

Figure 4:
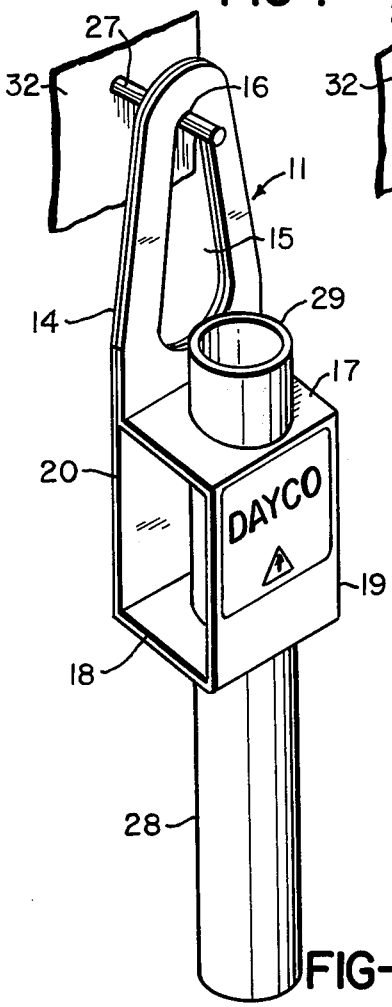
FIG. 4 is a perspective view of the device as hung in a typical wall display, illustrating a smooth exterior hose inserted within the openings and in locked position.

When the device is to be used, the horizontal portions 17 and 18 are arranged so that they are at right angles to the segment 14 and member 20, as shown in FIG. 3. By previous design, the openings 25 and 26 are slightly larger than the hose 28 shown in FIG. 4, permitting the hose to be passed through these openings so that the top end 29 is just barely above the opening 25. The hose is then released, allowing the weight extending below the opening 26 to displace the horizontal members 17 and 18 from their right angle positions, thus positioning them downward at a slight angle. This creates frictional contact between the outer surface of the hose and the edges of the openings. The resulting pressure of the sides of the opening against the hose create a locking action which holds the hose firmly in place. The display device and the hose may then be hung on a peg 27 on a display board 32, by passing the upper end 16 of the opening over the peg. Alternatively, the device 11 may be hung prior to insertion of the hose. The versatility of the device permits either process to be used with equal facility.

Figure 5:
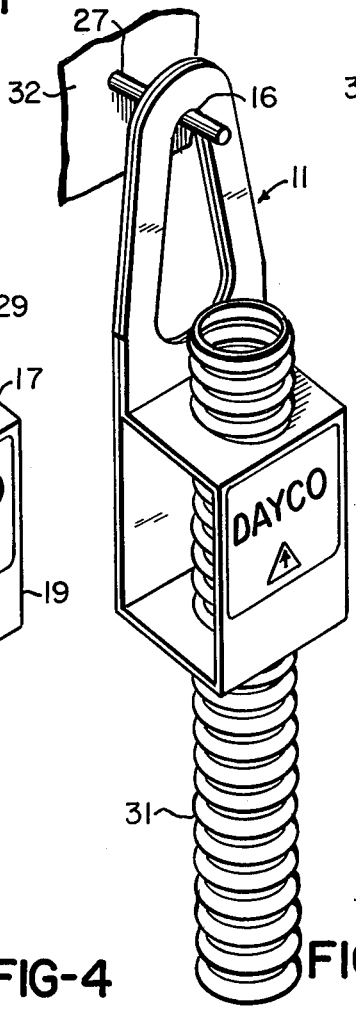
FIG. 5 is a view similar to FIG. 4, illustrating the installation of a corrugated exterior hose.

FIG. 5 illustrated the identical arrangement described above with the exception that a hose 31 having a corrugated exterior is used instead of a hose with a smooth diameter. Of course, it is understood that other types of hose, such as those with end fittings, may also be used in conjunction with this device. Further, other elongated tubular products may be used in conjunction with the display device, since the same principle applies. It should be noted that while the invention principally applies to flexible hose or similar objects, rigid tubing or similar objects may also be utilized with the novel display device.

When it is desired to remove the hose from the device, this may be done either by first removing the device from its peg 27 and then removing the hose, or by removing the entire assembly prior to removing the hose. In either case it is only necessary to push the hose upward in order to place the members 17 and 18 in the horizontal position shown in FIG. 3; or to push upward on either the members 17, 18, or portion 19 to create the same result. By relieving the frictional pressure between the hose and the openings, the locking effect is overcome and it is possible to remove the hose in a very simple manner.

Figure 6:
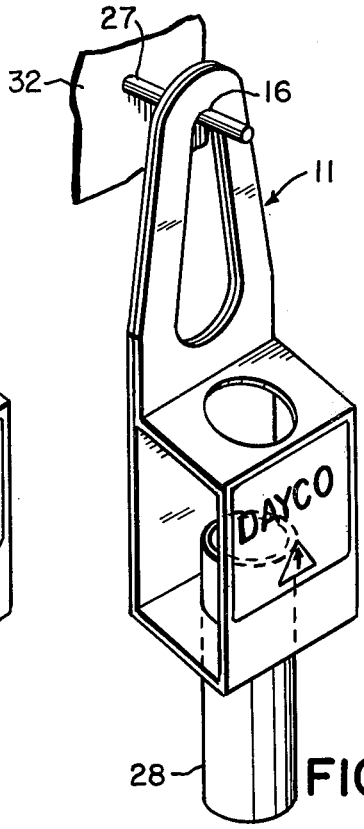
FIG. 6 illustrates a modified form of the invention in which the lower horizontal portion only of the device is used to support the hose.

Even though it is desirable to pass the hose completely through both circular openings 25 and 26, it is possible under some circumstances to utilize only the lower opening 26 as illustrated in FIG. 6. In this instance, the hose is shown as being passed through the opening 26 so that the weight of the hose causes the lower portion 18 to droop sufficiently to create the locking effect described above.

The above embodiments of the invention are illustrative, but it should be understood that the invention may be practiced by other embodiments and that the invention is set forth within the scope of the following claims.

What is claimed is:

1. In combination, a display device and an elongated tubular object mounted thereon; said device comprising a vertical member adapted to be hung for display, spaced upper and lower horizontal portions hingeably secured to and outwardly extending from said member at approximately right angles thereto and equal in width to the maximum width of said vertical member, and a vertical portion equal in width to and hingeably interconnecting said horizontal portions, each of said horizontal portions having a single centrally located circular opening in alignment with each other; said tubular object being fit within said openings so that its exterior surface is frictionally retained by only the edges thereof, the weight of said tubular member causing said horizontal portions to hinge downwardly away from said right angle position when said device is hung for display, thereby locking said object in place within said opening.

2. The combination of claim 1 in which said vertical member has an upper segment formed of two coinciding adhered portions having an opening therethrough for use in hanging said device.

3. The combination of claim 1 in which said openings have a diameter slightly larger than that of said tubular object.

4. The combination of claim 1 in which said tubular object has a smooth surface.

5. The combination of claim 1 in which said tubular object has a corrugated surface.

* * * * *